US008268273B2

(12) United States Patent
Döring

(10) Patent No.: US 8,268,273 B2
(45) Date of Patent: Sep. 18, 2012

(54) METHOD AND DEVICE FOR THE REGENERATION OF A PARTICLE FILTER ARRANGED IN THE EXHAUST GAS TRAIN OF AN INTERNAL COMBUSTION ENGINE

(75) Inventor: Andreas Döring, München (DE)

(73) Assignee: MAN Truck & Bus AG, Munich (DE)

( * ) Notice: Subject to any disclaimer, the term of this patent is extended or adjusted under 35 U.S.C. 154(b) by 274 days.

(21) Appl. No.: 12/539,995

(22) Filed: Aug. 12, 2009

(65) Prior Publication Data

US 2010/0041543 A1 Feb. 18, 2010

(30) Foreign Application Priority Data

Aug. 12, 2008 (DE) ..... 10 2008 038 719

(51) Int. Cl.

| | |
|---|---|
| ***B01D 47/00*** | (2006.01) |
| ***B01D 53/34*** | (2006.01) |
| ***B01D 53/56*** | (2006.01) |
| ***B01D 53/94*** | (2006.01) |
| ***B01J 8/00*** | (2006.01) |
| ***B01J 38/04*** | (2006.01) |
| ***F01N 3/00*** | (2006.01) |
| ***F01N 3/20*** | (2006.01) |
| ***G05B 1/00*** | (2006.01) |

(52) U.S. Cl. ..... 423/212; 423/213.5; 60/274; 422/105; 502/34

(58) Field of Classification Search ..... 60/274, 60/282–288, 295, 299, 303, 602; 423/213.5, 423/212, 215.5; 502/34; 422/105, 175; 95/23, 95/276; 55/282.2

See application file for complete search history.

(56) References Cited

U.S. PATENT DOCUMENTS

| | | | | |
|---|---|---|---|---|
| 4,857,089 | A | 8/1989 | Kitagawa et al. | |
| 5,067,973 | A * | 11/1991 | Pattas | 95/12 |
| 6,534,021 | B1 | 3/2003 | Maus | |
| 7,367,182 | B2 * | 5/2008 | Takahashi et al. | 60/286 |
| 2005/0011186 | A1 | 1/2005 | Saito et al. | |
| 2008/0120966 | A1 | 5/2008 | Sugiyama et al. | |
| 2010/0037607 | A1 | 2/2010 | Doring | |

FOREIGN PATENT DOCUMENTS

| | | |
|---|---|---|
| CH | 680788 | 11/1992 |
| DE | 19704147 | 8/1998 |
| DE | 100 43 613 | 2/2002 |
| DE | 10 2005 055 240 | 5/2007 |
| DE | 10 2007 033424 | 1/2009 |

(Continued)

*Primary Examiner* — Colleen Dunn
*Assistant Examiner* — Jennifer Smith
(74) *Attorney, Agent, or Firm* — Cozen O'Connor

(57) ABSTRACT

A method and a device for the regeneration of a particle filter, especially a diesel particle filter, arranged in the exhaust gas train of an internal combustion engine, wherein an exhaust gas stream to be cleaned is supplied to the at least one particle filter. The exhaust gas stream supplied to the at least one particle filter is a raw exhaust gas stream of the internal combustion engine, into which, during regeneration mode, a heated exhaust gas stream at a higher temperature than the raw exhaust gas stream is mixed at a point upstream of the particle filter under the control of at least one open-loop and/or closed-loop control device, which actuates a throttle device and/or shut-off device in accordance with predetermined regeneration parameters.

4 Claims, 3 Drawing Sheets

FOREIGN PATENT DOCUMENTS

| | | |
|---|---|---|
| EP | 0277012 | 8/1988 |
| EP | 0 341 832 | 11/1989 |
| EP | 1 072 765 | 1/2001 |
| EP | 2 154 344 | 2/2010 |
| FR | 2856108 | 12/2004 |
| FR | 2907158 | 4/2008 |
| FR | 2 924 749 | 6/2009 |
| JP | 11210440 | 8/1999 |
| WO | WO 2006/104240 | 10/2006 |
| WO | WO 2006104240 A1 * | 10/2006 |

* cited by examiner

METHOD AND DEVICE FOR THE REGENERATION OF A PARTICLE FILTER ARRANGED IN THE EXHAUST GAS TRAIN OF AN INTERNAL COMBUSTION ENGINE

BACKGROUND OF THE INVENTION

1. Field of the Invention

The present invention pertains to a method for the regeneration of a particle filter arranged in the exhaust gas train of an internal combustion engine and to a device for the regeneration of a particle filter arranged in the exhaust gas train of an internal combustion engine. The invention pertains in particular a method and to a device for regenerating particle filters in internal combustion engines operating with excess air such as diesel engines and gasoline engines with direct injection.

2. Description of the Related Art

To minimize fine particles "particle separators" or particle filters are usually used in vehicles. A particle separator arrangement for vehicles is known from EP 10 727 65 A2. These particle separators differ from particle filters in that the exhaust gas stream is conducted along the separator structures, whereas, in the case of particle filters, the exhaust gas is forced to flow through the filter medium. As a result of this structural difference, particle filters tend to clog, which increases the exhaust gas backpressure. A clogged filter causes an undesirable increase in pressure at the exhaust gas outlet of the internal combustion engine, which reduces engine power and leads to an increase in the amount of fuel consumed by the internal combustion engine. An example of a particle filter arrangement of this type is known from EP 03 418 32 A.

In the previously described arrangements, an oxidation catalyst located upstream of the particle separator or particle filter oxidizes the nitrogen monoxide (NO) in the exhaust gas to nitrogen dioxide ($NO_2$) with the help of the residual oxygen ($O_2$) also present in the exhaust gas according to the following equation:

$$2NO+O_2 \leftrightarrow 2NO_2.$$

In the particle filter, the $NO_2$ reacts with the solid carbon-containing particles to form CO, $CO_2$, $N_2$, and NO and thus regenerates the filter. The strong oxidizing agent $NO_2$, therefore, makes it possible to achieve continuous removal of the deposited fine particles known as passive regeneration. Nevertheless, this device and the way the method is implemented suffers from the disadvantage that a large amount of toxic $NO_2$ is formed and/or is present in the exhaust gas system.

To prevent the escape of $NO_2$ into the environment, care must therefore be taken to ensure that the area between the NO oxidation catalysts and the particle filters is sufficiently leak-proof. According to this method not only $NO_2$ but also $SO_3$ is formed, the latter being produced on the platinum-containing NO oxidation catalysts from the sulfur contained in the fuel and/or motor oil. This $SO_3$ and the $NO_2$ condense on cold spots in the exhaust gas train and form highly corrosive sulfuric acid and nitric acid, so that the exhaust gas system must be made of high-grade steel up as far as the particle filter to avoid corrosion reliably.

It is also known that a particle filter can be regenerated by raising the exhaust gas temperature. For this purpose, DE 102 0050 552 40 A1 describes a design in which a catalyst for oxidizing hydrocarbons, an HC oxidation catalyst, a diesel particle filter, and then an SCR catalyst are arranged one after the other in the exhaust gas flow direction in the main exhaust gas train. A secondary exhaust gas train is also provided that branches off from the main exhaust gas train upstream of the HC oxidation catalyst and which leads back into the main exhaust gas train after the diesel particle filter. A throttle for regulating the exhaust gas stream to be branched off, an oxidation catalyst, and a particle separator downstream of the oxidation catalyst are provided in the secondary exhaust gas train. In a design of this type, the throttle flap closed during normal operation, so that all of the exhaust gas stream flows through the main exhaust gas train and is cleaned there. During a regeneration phase of the diesel particle filter in the main exhaust gas train the throttle flap is opened to allow a portion of the exhaust gas stream to flow through the secondary exhaust gas train and thus bypass the diesel particle filter, after which the two exhaust gas streams, i.e., the stream flowing through the main exhaust gas train and the one flowing through the secondary exhaust gas train, are brought back together again at a mixing point upstream of the SCR catalyst.

As a result of this operating mode, the mass of exhaust gas flowing through the diesel particle filter is decreased during the filter's regeneration phase, so that it is only necessary to raise the temperature of a smaller amount of exhaust gas, and the diesel particle filter can be regenerated with a smaller input of energy. In addition, by splitting the mass flow of exhaust gas mass into two parts and subsequently mixing the exhaust gas stream of the main exhaust gas train, which is at a high temperature, with the exhaust gas stream of the secondary exhaust gas train, which is at a low temperature, at the mixing point, it is said that the temperature of the exhaust gas stream flowing through the SCR catalyst can be reduced again. The particle separator in the secondary gas train, furthermore, is said to prevent an exhaust gas stream from which soot particles have not been separated from leaving the exhaust gas train.

The hydrocarbons (HCs) are added to the oxidation catalysts by an injection device directly upstream of the catalyst. Because, in a design of this type, the oxidation catalysts are oxidizing NO to $NO_2$ even during non-regeneration mode, passive filter regeneration with $NO_2$ takes place even in non-regeneration mode, although to only a small degree. This means that, in a design of this type, $NO_2$ is formed even during non-regeneration mode, and this is then usually emitted without being used. Because of the toxicity of $NO_2$, however, this is impracticable and undesirable.

It is obvious that a design of this type has a relatively large number of parts, nor is it very compact, and thus overall it occupies a large amount of space.

SUMMARY OF THE INVENTION

A goal of the present invention is to provide a method and a device for the regeneration of a particle filter arranged in the exhaust gas train of an internal combustion engine by which particle filters can be regenerated effectively and reliably in a simple and compact manner while minimizing the emissions of $NO_2$ and $SO_3$.

According to one embodiment of the invention, the exhaust gas stream supplied to the at least one particle filter is a raw exhaust gas stream of the internal combustion engine, into which, during regeneration mode, a heated exhaust gas stream at a given temperature higher than that of this raw gas steam is mixed at a point upstream of the particle filter in a manner controlled by an open-loop and/or closed-loop control device, which actuates a throttle device and/or a shut-off device in accordance with predetermined regeneration parameters. The raw exhaust gas stream is conducted through a raw exhaust gas line, to which the heated exhaust gas stream is supplied at a point upstream of the particle filter by means of another exhaust gas line, which is referred to here as a "feed line".

A "raw exhaust gas stream" is an exhaust gas stream which does not flow through an NO oxidation catalyst upstream of the particle filter and which therefore is an exhaust gas stream from the combustion process which is loaded with soot particles but which is essentially free of $NO_2$ or contains only a small amount of $NO_2$.

According to a preferred embodiment, the exhaust gas stream to be heated is branched off from the raw exhaust gas stream at a branching point upstream of the at least one particle filter, wherein this branched-off exhaust gas stream is heated by a heater, preferably by means of at least one heating catalyst, and then, in the form of a heated exhaust gas stream, is returned through the feed line to the raw exhaust gas stream at an entry point downstream of the branching point and upstream of the at least one particle filter.

With an inventive solution of this type, it is possible to achieve effective and reliable particle filter regeneration while minimizing the $NO_2$ and/or $SO_3$ emissions without the use of NO oxidation catalysts installed upstream of the at least one particle filter. This is accomplished in particular by minimizing the amount of exhaust gas branched off during non-regeneration mode via the feed line to a predetermined value, especially by preventing essentially any exhaust gas stream at all from flowing through the feed line. As a result, the formation of $NO_2$ and $SO_3$ by the oxidation of NO and $SO_2$ on the heater, preferably designed as a hydrocarbon (HC) oxidation catalyst, is prevented or decreased.

Conversely, for the regeneration phase of the particle filter, the amount of exhaust gas branched off from or conducted via the feed line can be increased to a predetermined value by the release or opening of the at least one throttle device and/or shut-off device, and then the hydrocarbons can then be metered in. During this regeneration phase, the formation of $NO_2$ and $SO_3$ is not to be expected, because, their catalytic formation is suppressed in the presence of hydrocarbons and the thermodynamic $NO/NO_2$ and $SO_2/SO_3$ equilibria are on the side of NO and $SO_2$ at the temperatures of over 700° C. prevailing during the regeneration on the heater, which is preferably designed as an HC oxidation catalyst. This means that the formation of $NO_2$ and $SO_3$ are limited or even prevented entirely for purely thermodynamic reasons. As a result of the exothermic reaction or oxidation of the hydrocarbons, it is possible to achieve effective and optimal thermal regeneration of the particle filter by removal of carbon-containing soot particles deposited on the downstream.

As previously explained, the present inventive idea calls for the production of the heated exhaust gas stream preferably by means of at least one heating catalyst, which is arranged in the feed line. This heating catalyst is preferably designed as an oxidation catalyst, especially as an HC oxidation catalyst. Hydrocarbons are supplied to this oxidation catalyst on the upstream side. The supplied hydrocarbons are preferably the hydrocarbons of the fuel from the fuel system of the motor vehicle, which is sprayed in ultrafinely distributed or atomized form into the branch line upstream of the heating or oxidation catalyst by a metering device such as a nozzle or the like at predetermined times and in predetermined quantities. A heating or oxidation catalyst of this type comprises an active component which reacts exothermically with given components of exhaust gas stream, i.e., in the present case with the hydrocarbons, to produce a heated exhaust gas stream. The elements of the platinum metal group and/or vanadium and/or tungsten and/or cerium are especially suitable as active components for an HC oxidation catalyst. These active components are applied and/or used either alone or in combination with each other.

In concrete terms, the open-loop and/or closed-loop control device actuates a throttle device and/or shut-off device, which is formed by at least one throttle flap, shut-off flap, a throttle valve, and/or shut-off valve. These flap or valve elements can be easily and effectively actuated and operated, wherein they are preferably arranged in the raw exhaust gas stream downstream of the branching point and upstream of the entry point or in the branched-off exhaust gas stream at a point upstream of the heating catalyst.

To ignite the injected hydrocarbons, the exhaust gas stream to be heated is conducted over the heater, preferably designed as an HC oxidation catalyst, as a result of which the exhaust gas stream is heated. The heat output which can thus be achieved is limited by the amount of oxygen present. If lambda reaches a value of 1 as a result of the addition of an excessive amount of hydrocarbons, the oxidation of the hydrocarbons is no longer possible. To avoid this, fresh air is supplied to the exhaust gas stream to be heated after it has reached a certain predetermined temperature and/or after lambda or oxygen has fallen below or reached a certain predetermined value. This optional fresh-air feed brings about an increase in lambda and thus also an increase in the maximum possible heat output. The fresh air can be generally be branched off on the charging-air side; it can be branched off downstream of a an entry point of an exhaust gas return line into a charging-air line.

As a result of the addition of hydrocarbons, i.e., after the hydrocarbons have been added, the residual oxygen content can decrease very sharply in the exhaust gas stream which is to be heated and/or which has been heated as a result of the oxidation of the HCs on the HC oxidation catalyst. Under certain conditions, therefore, the complete oxidation of all the hydrocarbons may not be possible any longer. To prevent this, the raw exhaust gas stream can, alternatively or in addition, be throttled downstream of the branching point but upstream of the entry point, as a result of which more exhaust gas and thus more oxygen are conducted through the branch line. In one embodiment, at least one oxygen sensor can also be installed in the area of the branch line, downstream and/or upstream of the heating catalyst, to detect the oxygen concentration in the exhaust gas stream. In one embodiment, at least one temperature sensor can also be installed there.

The heating catalyst could also be arranged outside the exhaust gas train.

Under certain conditions this can lead to the relatively rapid cooling of this heating catalyst. According to a preferred embodiment the heating catalyst is arranged in the exhaust gas train such that at least one exhaust gas stream, especially the raw exhaust gas stream, flows around at least certain parts of the heating catalyst. In this case, the exhaust gas stream conducted via the raw exhaust gas line and the stream conducted via the feed line are fluidally isolated from each other.

To avoid high hydrocarbon concentrations downstream of the particle filter in cases where hydrocarbons are used as oxidizing agents, the filter is provided with a catalyst for the oxidation of hydrocarbons. It is also conceivable to install a catalyst with hydrocarbon oxidation activity downstream and/or upstream of the particle filter after the entry point. To avoid unnecessarily high $NO_2$ and $SO_3$ emissions, the loading of these additional catalysts with active components and/or their volume is smaller than that of the at least one heating catalyst arranged in the feed line.

The entire system can be combined with additional catalysts for $NO_x$ reduction such as, for example, $NO_x$ storage catalysts and/or SCR catalysts, which can provided or installed preferably in the exhaust gas train downstream of the particle filter. At least one of platinum, barium, calcium is preferred as the active component for the $NO_x$ storage catalysts. For the SCR catalysts the use of tungsten oxide-stabilized vanadium pentoxide on a titanium dioxide base, iron zeolites, copper zeolites, or cobalt zeolites, is effective.

In principle, the activity of all the catalysts is increased by the use of zeolites.

In principle, the at least one heating catalyst, preferably designed as an HC oxidation catalyst, is provided with NO oxidation activity, as a result of which the percentage of $NO_2$ produced during non-regeneration mode can be increased. Additionally, particle filter regeneration within certain limits can be obtained with the help of $NO_2$. The quantities of $NO_2$ which may be formed are much smaller than those which would be obtained from the use of NO oxidation catalysts upstream of the particle filter. Nevertheless, it should also be kept in mind in this connection that the HC oxidation catalyst must be designed with thermal stability. This thermal stability usually results in turn in a lower degree of NO oxidation activity than that of a pure NO oxidation catalyst, so that, for this reason as well, the amount of NO remains lower.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of drawings, in which.

DETAILED DESCRIPTION OF THE PRESENTLY PREFERRED EMBODIMENTS

Figure 1:
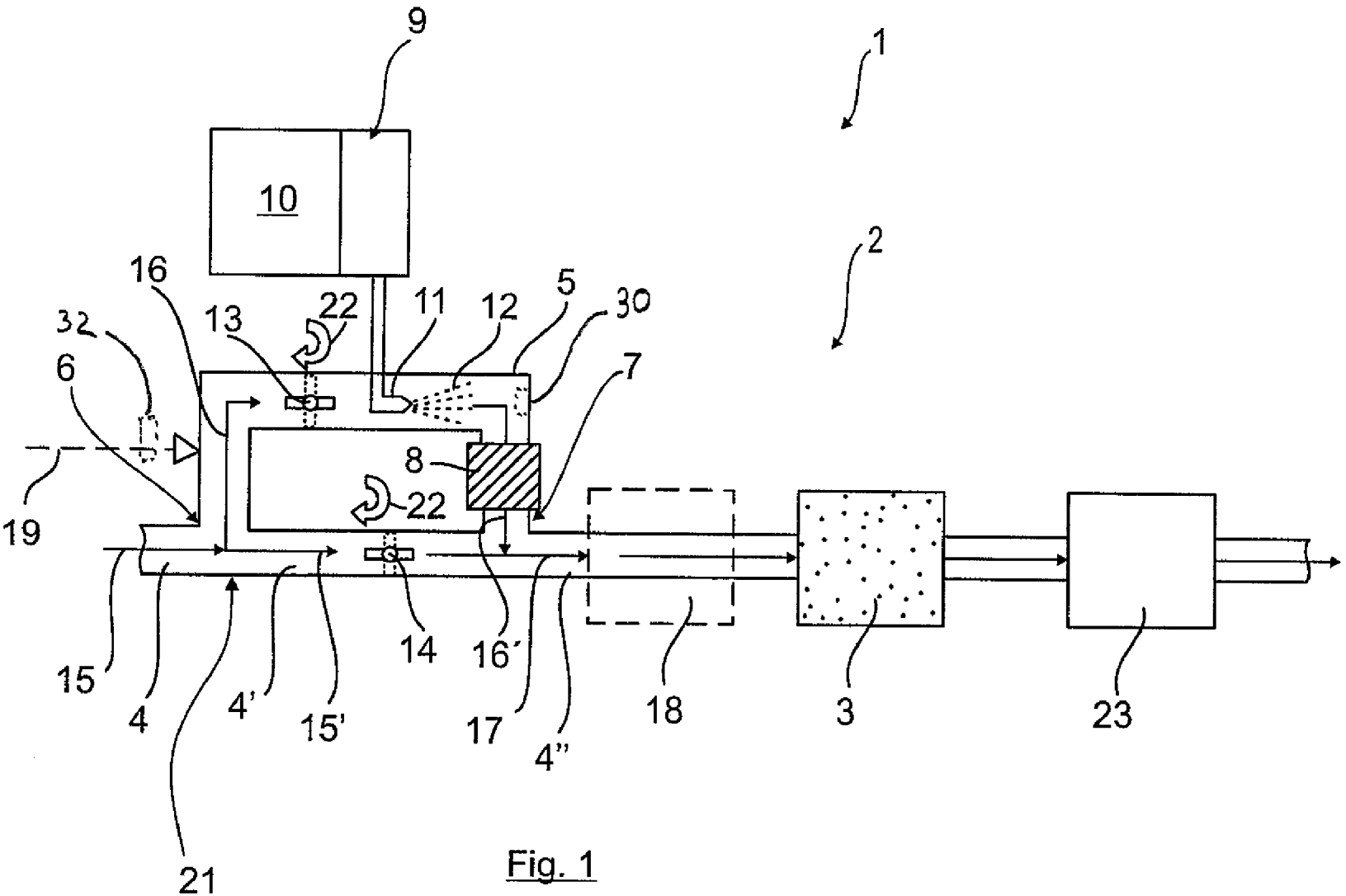
FIG. 1 is a schematic diagram of a first inventive embodiment of the invention.

FIG. 1 is a schematic diagram of a first embodiment of an inventive regeneration device 1 for a particle filter 3, arranged in the exhaust gas train 2 of an internal combustion engine (not shown).

In concrete terms, the exhaust gas train 2 comprises here a raw exhaust gas line 21 with a first section of line 4, from which a feed line 5 branches at a branching point 6 upstream of the particle filter 3. Feed line 5 is also brought back together, at a point upstream of the particle filter 3, namely, at an entry point 7, with the line section 4', which extends downstream from the branching point 6, to form the line section 4".

An HC oxidation catalyst 8 is arranged in the feed line 5.

The regeneration device 1 also comprises a metering device 9 for fuel, which, as shown in highly schematic fashion, is connected to an open-loop and/or closed-loop control device 10. The metering device 9 comprises an injection nozzle 11 projecting into the feed line 5, which is designed in the manner of a bypass line. Through this nozzle 11, during regeneration mode, fuel 12 can be sprayed into the feed line 5 upstream of the HC oxidation catalyst 8 at predetermined times and in predetermined amounts under the open and/or closed-loop control of the control device 10.

As can also be derived from FIG. 1, a throttle flap 13 is also arranged upstream of the HC oxidation catalyst 8 in the area of the feed line 5; this flap is also connected to an open-loop and/or closed-loop control device 10. A throttle flap 14, which is preferably also connected to the open-loop and/or closed-loop control device 10, is installed in the line section 4' in the area between the branching point 6 and the entry point 7.

Depending on the position of the throttle flaps 13, 14, the quantity and mass of an exhaust gas stream 16 to be heated, i.e., the exhaust gas stream branched off into the feed line 5 from the raw exhaust gas stream 15 coming from internal combustion engine, can be specified and/or automatically controlled. The maximum open positions of the throttle flaps 13, 14 are shown by the solid lines in FIG. 1, and the closed positions of the throttle flaps 13, 14 are shown by the dotted lines. The arrow designated "22" is intended to illustrate schematically the various adjustment possibilities of the throttle flaps 13, 14.

The exhaust gas stream 16 to be heated takes up the fuel or hydrocarbons sprayed into it along its flow route upstream of the HC oxidation catalyst 8. The exhaust gas stream enriched with fuel flows through the HC oxidation catalyst 8, in which an exothermic reaction or oxidation then takes place, as a result of which the exhaust gas stream 16 is heated to a predetermined temperature.

The heated exhaust gas stream 16' is then mixed back into the raw exhaust gas stream 15' flowing through the line section 4' at the entry point 7 downstream of the HC oxidation catalyst 8, where the two exhaust gas streams 15', 16' mix together, so that, after the two exhaust gas streams 15', 16' have been combined, a heated mixed stream 17 flows to the particle filter 3, where the carbon-containing soot particles deposited in the particle filter 3 are converted to CO, $CO_2$, $N_2$, and NO, as a result of which the particle filter 3 is regenerated.

In non-regeneration mode, the throttle flap 13 is actuated in such a way that it closes off the feed line 5 essentially completely, so that no or nearly no exhaust gas stream arrives at the particle filter 3 via the feed line 5. In this case, the throttle flap 14 is completely open.

During regeneration mode the throttle flap 13 is opened to such an extent that a predetermined amount of exhaust gas is branched off from the raw exhaust gas stream 15, and a heated mixed stream 17 produced in the previously described manner is conducted to the particle filter 3 to regenerate the particle filter 3.

In the event that as a result of the addition of the fuel 12 in the feed line 5, the residual oxygen content in the exhaust gas stream 16 decreases too much and thus the hydrocarbons are no longer being completely oxidized on the HC oxidation catalyst, the throttle flap 14 can be closed to a greater or lesser extent and the throttle valve 13 opened, as a result of which the raw exhaust gas stream 15' passing through the line section 4' is throttled, so that a larger amount of exhaust gas 16 and thus a larger amount of oxygen flows through the feed line 5 and thus through the HC oxidation catalyst 8 to the particle filter 3.

As symbolized by the fresh-air line 19 shown in dashed line, controlled by shut off element 32 a charging air-side fresh-air stream can also be mixed into the exhaust gas stream 16 to be heated during regeneration mode at predetermined times and/or when specified exhaust gas stream temperatures are reached and/or when the lambda or oxygen value falls below a predetermined limit to achieve a further increase in the heat output by increasing the amount of oxygen available.

In the present example, an $NO_x$ reduction catalyst 23, such as an SCR catalyst, is installed downstream of the particle filter 3.

As indicated only in dashed line in FIG. 1 an additional HC oxidation catalyst 18 is provided downstream of the entry point 7 and upstream of the particle filter 3, by means of which high hydrocarbon concentrations downstream of the particle filter 3 can be reliably avoided. Alternatively or in addition, it is also possible to provide the particle filter 3 itself with an appropriate active component. In one embodiment, at least one sensor 30 which is one or more of an oxygen sensor and temperature senor is provided in feed line 5.

Figure 2:
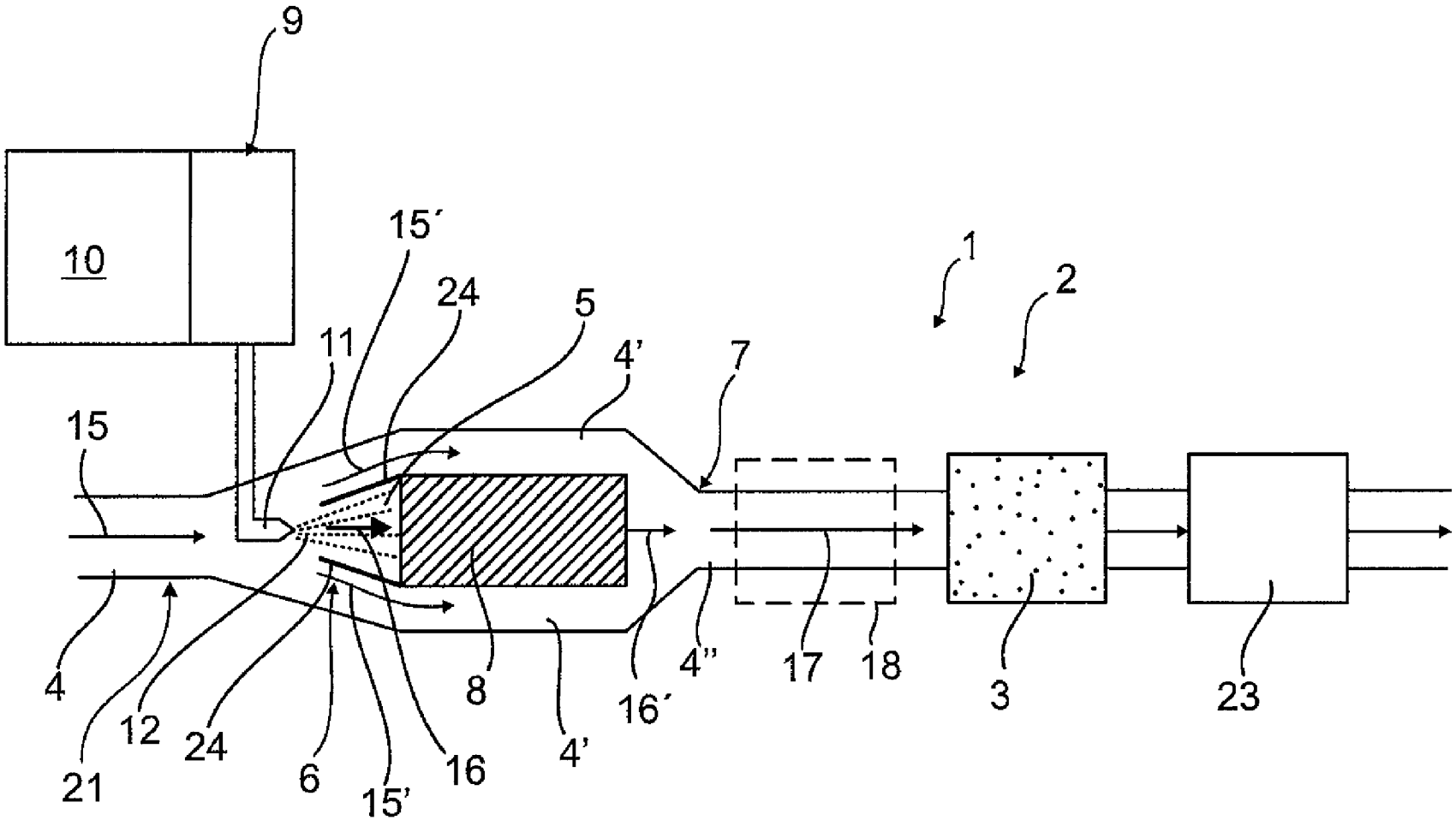
FIG. 2 is a schematic diagram of an embodiment of the invention representing an alternative to FIG. 1 with an HC oxidation catalyst arranged within the exhaust gas stream.

FIG. 2 is a schematic diagram of a second embodiment of an inventive regeneration device 1, in which the HC oxidation catalyst 8 is arranged and accommodated inside a section of the raw exhaust gas line which surrounds the HC oxidation catalyst in a ring-like manner, as a result of which an especially compact and thus space-saving design is obtained. The raw exhaust gas stream 15 flowing through a first line section 4 of the raw exhaust gas line 21 toward the HC oxidation catalyst is divided by one or more flow guide elements 24 into a first exhaust gas stream 15' flowing only through the line section 4' of the raw exhaust gas line 21 and a to-be-heated second exhaust gas stream 16 flowing only through the HC oxidation catalyst 8.

Figure 3:
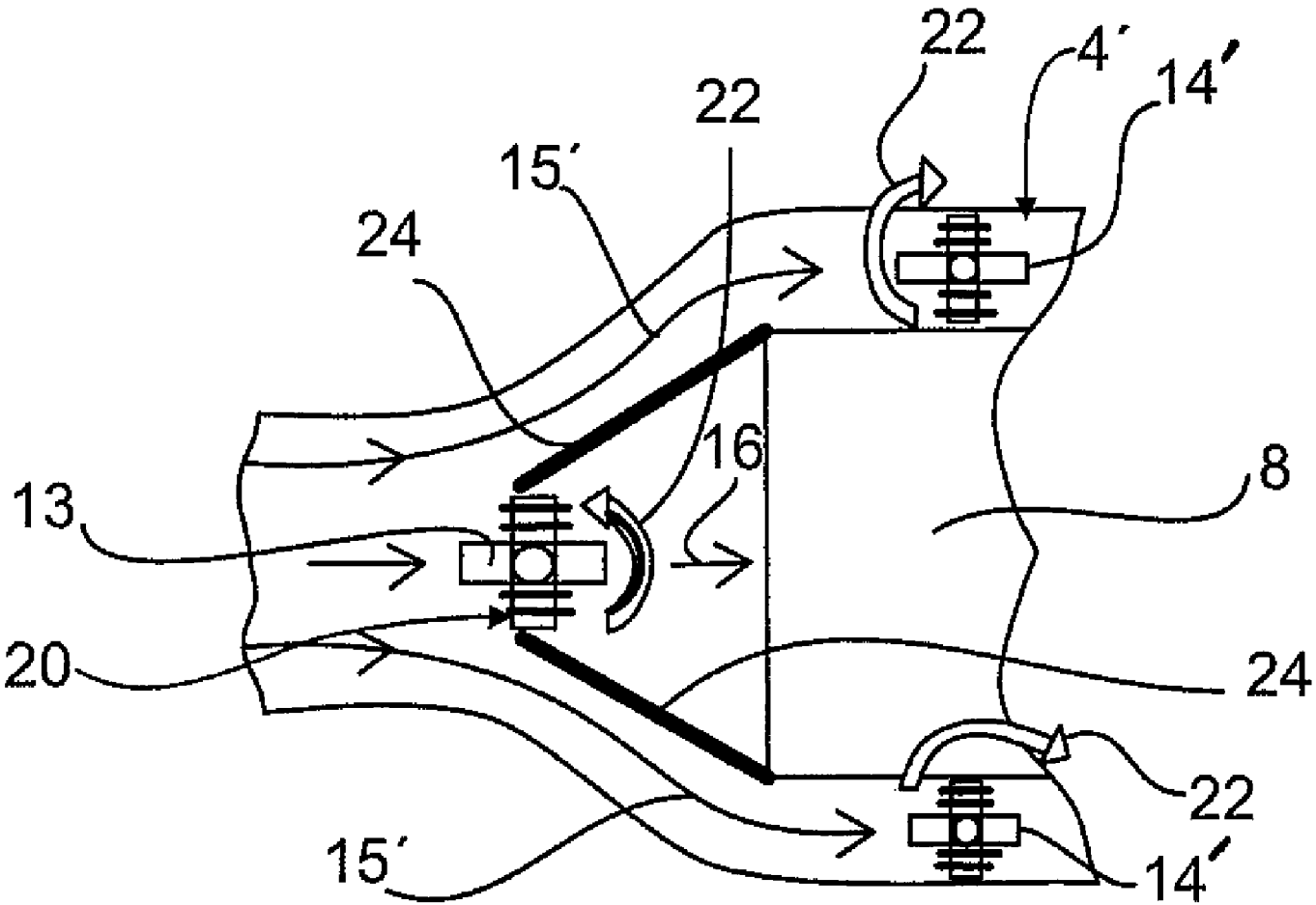
FIG. 3 is a schematic diagram of an enlarged view of a section of pipeline where branching occurs.

As can be seen in FIG. 3, it is possible, to use a throttle flap 13' formed or arranged in the area of the entrance 20 to the flow guide elements 24 to control the amount of to-be-heated second exhaust gas stream 16 which is branched off during the regeneration phase and/or during the non-regeneration phase.

The mass of the second exhaust gas stream 16 flowing through the HC oxidation catalyst 8 is therefore determined by the geometry of the flow guide elements 24 and/or by the position of the throttle flap 13 supported on these elements. Here, too, the throttle flap 13 is actuated by the electronic open-loop and/or closed-loop control device 10 as a function of predetermined regeneration or operating parameters, similar to the actuation of the throttle flap 13 described above in conjunction with the embodiments of FIG. 1.

Directly upstream of the entrance 20 to the flow guide elements 24, an injection nozzle 11 of a metering device 9 is again arranged, by means of which fuel 12 can be sprayed into the second exhaust gas stream 16, so that an exothermic reaction takes place in the HC oxidation catalyst 8 and a heated exhaust gas stream 16', leaving the HC oxidation catalyst 8, can be mixed with the raw exhaust gas stream 15' to form a heated exhaust gas stream 17. This heated exhaust gas stream 17 flows through the particle filter 3 and then through an $NO_x$ reduction catalyst 23, as previously described in connection with FIG. 1.

The flow areas formed by the flow guide elements 24, in a manner similar to that of the embodiments according to FIGS. 1 and 2, form here again a line section 4' branching from the line section 4 and also a "feed line" 5, which are then brought back together in the area downstream of the HC oxidation catalyst 8 to form a common line section 4".

In the area of the line sections 4', in a manner similar to that of the embodiment of FIG. 1, it is possible again to provide a throttle flap or flaps 14', by means of which the geometry of the ring-shaped space can be closed off to a greater or lesser extent. The selected diagram of two throttle flaps 14' does not take into account the annular geometry and serves only the purpose of schematic illustration.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A method for the regeneration of at least one particle filter arranged in an exhaust gas train of an internal combustion engine, wherein a raw exhaust gas stream to be cleaned is supplied to the at least one particle filter, the method comprising:

branching off, from the raw exhaust gas stream, an exhaust gas stream to be heated at a branching point upstream of the at least one particle filter;

heating the branched-off exhaust gas stream by a heater to form a heated exhaust gas stream;

supplying the raw exhaust gas stream to the at least one particle filter;

mixing, during a regeneration mode, the heated exhaust gas stream with the raw gas exhaust stream at an entry point downstream from the branching point and upstream of the at least one particle filter, the heated exhaust gas stream at a higher temperature than the raw exhaust gas stream, the mixing occurring under control of at least one control device configured to actuate at least one of a throttle device and a shut-off device based at least in part on predetermined regeneration parameters; and supplying a fresh-air stream to the exhaust gas stream to-be-heated after at least one of a predetermined heating temperature is reached as measured in the heated exhaust gas stream and after a predetermined lambda value is reached, wherein, when at least one of an oxygen content and a lambda value of a to-be-heated exhaust gas stream falls below at least one of a predetermined oxygen limit value or lambda limit value during the regeneration mode, the control device at least one of shuts off and throttles the exhaust gas stream downstream of the branching point by at least one of the at least one throttle device and the shut-off device such that a predetermined amount of exhaust gas is branched off from the raw exhaust gas stream based at least in part on at least one of the oxygen content of the raw exhaust gas stream, the lambda value of the raw exhaust gas stream, and a function of the oxygen content or lambda value of the exhaust gas stream which is to be heated and which has been heated and sent to the at least one heating device arranged upstream of the entry point of the heated exhaust gas stream which has been branched off for heating.

2. The method according to claim 1, further comprising:

actuating, by the control device, the at least one of the throttle device and the shut-off device, the at least one of the throttle device and the shut-off device being arranged in the raw exhaust gas stream downstream of the branching point and upstream of the entry point and in the branched-off exhaust gas stream such that, during the regeneration mode, a predetermined amount of the exhaust gas to be heated is branched off from the raw exhaust gas stream based at least in part on at least one of a predetermined operating parameter and a regeneration parameter.

3. The method according to claim 2, wherein, during a non-regeneration mode, the at least one of the throttle device and the shut-off device at least one of substantially prevents the mixing of the heated exhaust gas stream with the raw exhaust gas stream and reduces the mixing of the heated exhaust gas stream with the raw exhaust gas stream to a predetermined minimum value.

4. The method according to claim 1, wherein the heated exhaust gas stream is produced by at least one heating catalyst serving as a heater, the heater comprising at least one active component configured to produce an exothermic reaction, the heating catalyst configured as an HC oxidation catalyst, the method further comprising:

conducting the to-be-heated exhaust gas stream loaded with hydrocarbons through at least one heating catalyst so that the to-be-heated exhaust gas stream is heated by the exothermic reaction of the hydrocarbons, wherein the hydrocarbons are metered into the exhaust gas stream to-be-heated at a point upstream of the heating catalyst at predetermined times and in predetermined amounts by a metering device under control of the control device.

* * * * *